US005595151A

United States Patent [19]

Powell et al.

[11] Patent Number: 5,595,151

[45] Date of Patent: Jan. 21, 1997

[54] RELEASABLE CONNECTION FOR MOLDED PARTS

[75] Inventors: Jeffrey J. Powell, Windsor, Canada; Tony A. Price, Lake Orion, Mich.; Lisa Whaley, Wheatley, Canada

[73] Assignee: Siemens Electric Limited, Ontario, Canada

[21] Appl. No.: 570,225

[22] Filed: Dec. 11, 1995

[51] Int. Cl.[6] ..... F02M 35/10

[52] U.S. Cl. ..... 123/184.61; 123/184.21

[58] Field of Search ..... 123/184.61, 184.21

[56] References Cited

U.S. PATENT DOCUMENTS

| | | | |
|---|---|---|---|
| 4,887,557 | 12/1989 | Sukimoto et al. | 123/184.61 |
| 5,003,933 | 4/1991 | Rush, II et al. | 123/184.61 |
| 5,235,938 | 8/1993 | Haussmann et al. | 123/184.21 |
| 5,273,010 | 12/1993 | Elder | 123/184.61 |
| 5,341,772 | 8/1994 | Dohring et al. | 123/339.1 |
| 5,435,279 | 7/1995 | Brummer et al. | 123/184.21 |
| 5,477,819 | 12/1995 | Kopec | 123/184.61 |

FOREIGN PATENT DOCUMENTS

| | | | |
|---|---|---|---|
| 0351520 | 1/1990 | European Pat. Off. | 123/184.61 |
| 3219699 | 12/1983 | Germany | 123/184.61 |
| 4-54269 | 2/1992 | Japan | 123/184.61 |

*Primary Examiner*—David A. Okonsky
*Attorney, Agent, or Firm*—Russel C. Wells

[57] ABSTRACT

A releasable connection for attaching a cover to a molded intake manifold including a series of projections on the cover received into recesses in a flange molded into the manifold. Tapered recesses in the projections and adjacent sloping surfaces in the flange define opposing spaced surfaces, with a key pin inserted between the opposing surfaces to lock the cover to the flange.

4 Claims, 2 Drawing Sheets

RELEASABLE CONNECTION FOR MOLDED PARTS

BACKGROUND OF THE INVENTION

This invention concerns releasable connections for attaching one part to another. Releasable connections for attaching one part to another most commonly involve the use of threaded fasteners passing though one part and received in threaded holes in the other part.

When connecting molded plastic parts where high strength is required, metal screws cannot be directly received into threaded holes in the plastic material, but metal inserts must be installed in enlarged bores in one part and secured therein, as by heat staking. Threaded bores in the inserts receive the attaching screws.

The process of installing the inserts, and the cost of the inserts themselves can add to the cost of production, which costs are particularly significant where large production volumes are involved. In situations where the production is automated, complex equipment is required to accurately locate and form the bores for the inserts and secure the inserts as by heat staking, resulting in substantial capital expense for the manufacturer.

In the automotive industry, automated production is used to the maximum extent possible, and molded plastic composite materials are increasingly used in order to save weight for such parts as engine intake manifolds, which were formerly made of cast aluminum.

Fuel delivery systems for automotive engines are becoming more sophisticated, involving the use of functional components in the intake manifold cavities, which components must be accessible for servicing. Thus, covers have been proposed to be releasably attached to close openings in the intake manifold so as to enable removal of internal components.

In such applications, it would be highly desirable to releasably attach the cover without the necessity of installing inserts in the composite material.

Accordingly, it is an object of the present invention to provide a releasable connection which does not require threaded fasteners, and which is particularly adapted to securely attach molded parts together at low, such as a cover for a molded composite plastic intake manifold.

SUMMARY OF THE INVENTION

The above object is achieved by a connection comprised of part features which are interfit as one part is advanced onto the other to be assembled together, the interfit features preventing relative movement between the parts except along the direction of assembly advance. Shaped portions are formed in the respective parts which define spaced apart surfaces opposing each other along the direction of assembly advance, and a key element is inserted into the intervening space to lock the parts in their assembled condition together.

The interfit features are configured to be easily moldable, comprising a series of spaced tapered projections on one part fitted into complementary recesses in the other part. The projections are themselves formed with inner vee shaped recesses with rounded bottoms.

The other part is additionally formed with a series of rearward facing sloping surfaces, each located alongside a projection recess and which extend in a generally orthogonal direction extending across the projection recesses. A rounded segment of each sloping surface is partially aligned with a portion of the rounded bottom of the projection recess.

The partial alignment creates the opposed spaced surfaces and a key pin inserted crosswise through the intervening space locks the parts together.

The tapered or sloping shape of the projection, recesses, and sloping feature readily allows molding of each of the parts, the projections and surfaces each extending in the separation direction of the mold halves.

The connection according to the invention has particular application to a cover for an automotive intake manifold opening, where both the manifold and cover are molded.

DETAILED DESCRIPTION

Figure 1:
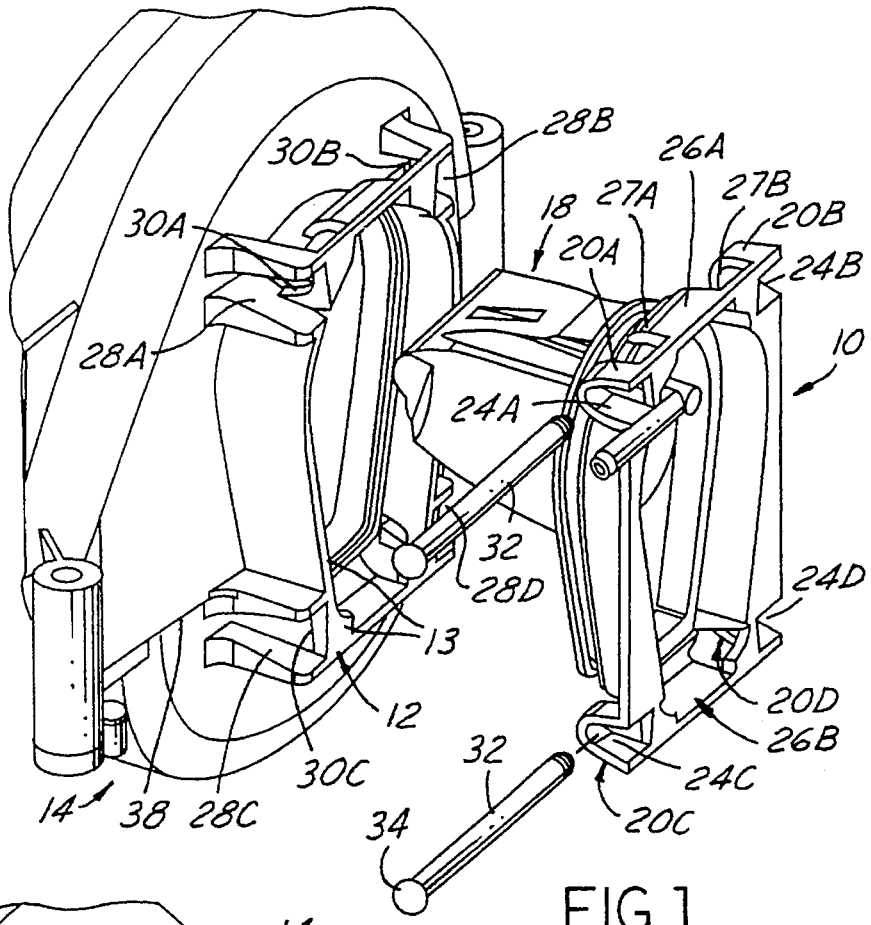
FIG. 1 is an exploded perspective view of a releasable connection according to the present invention, with a fragmentary view of an intake manifold to which a cover (shown complete) is releasably attached by the connection according to the invention.
Figure 2:
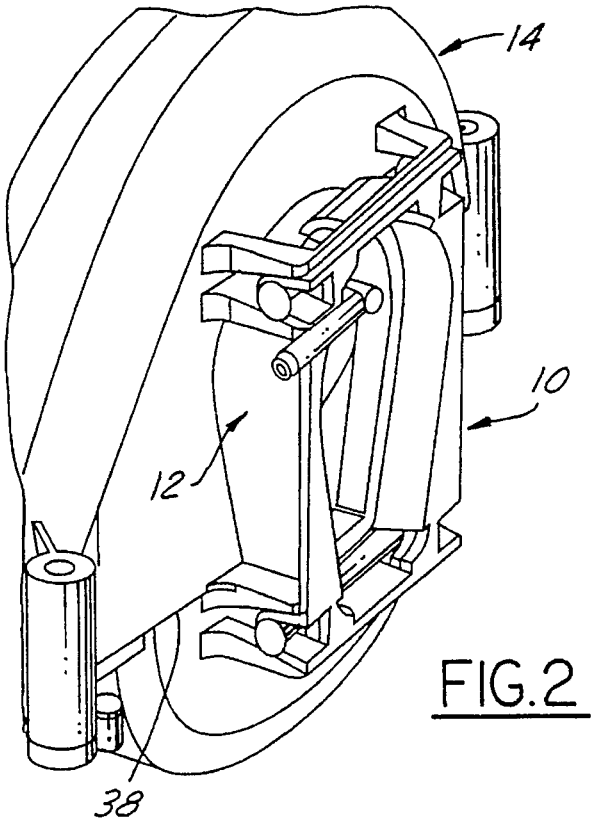
FIG. 2 is a perspective assembled view of the intake manifold cover connection shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the releasable connection according to the invention is shown applied to attaching a cover 10 to a flange 12 integral with an automotive intake manifold 14. The intake manifold 14 is shown with an opening 16 in one end receiving certain operating components 18 which are not a part of the present invention, which must be accessible for servicing. The cover 10 is removably attached to the flange 12 for servicing purposes.

The cover 10 has a generally rectangular main wall portion 11 corresponding to a corresponding mounting surface 13 of the flange 12.

The top and bottom sides of the cover 10 and flange 12 are each formed with a series of features which are interfit together when the aligned cover 10 is advanced onto the flange 12 in a direction perpendicular to the plane of the main wall 11 of the cover 10 and mounting surface 13 of the mounting flange 12. This interfitting acts to prevent relative movement between the cover 10 and flange 12 in any direction other than the direction in which the cover is advanced to carry out assembly.

These interfit features include a pair of integrally formed side-by-side projections 20A, 20B spaced apart along the top side of the cover 10, and a second pair of integrally formed projections 20D, 20C spaced apart along the bottom side of the cover 10, respectively located at each corner of the cover main wall 11. Each of these projections 20A, 20B, and 20D, 20C are formed in a rounded bottom vee or tapering shape and extend perpendicularly away from the main wall of the cover 10.

Each of the projections 20A, 20B, 22C, 22D are further formed with a tapering, open-ended recess 24A–D in a rounded bottom vee shape complementary to the outer contour of the associated projection.

Central out projections 26A, 26B also extend from the top and bottom sides, spaced from the projections 20A–D by intervening recesses 27A–D.

The intake manifold mounting flange 12 is formed with a series of four tapering, open-ended recesses 28A–D located at each corner, extending perpendicularly in from the surface 13, which recesses are configured and located to mate with the cover projections 20A–D as the cover 10 is advanced to be assembled to the flange 12, precisely the projection recesses 24A–D in the flange 12. The flange surface 13 and cover main wall 11 move into abutment as the cover 10 is fully advanced onto the flange 12.

Figure 3:
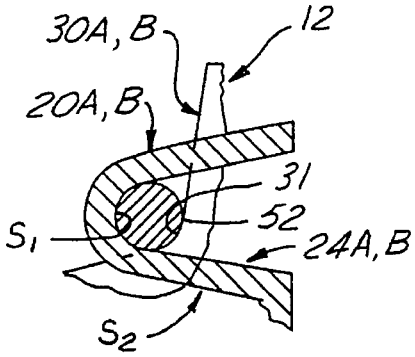
FIG. 3 is a fragmentary end view of portions of the connected part, showing the relationship of the opposing surfaces on the respective parts and the key pin installed in the intervening space.
Figure 4:
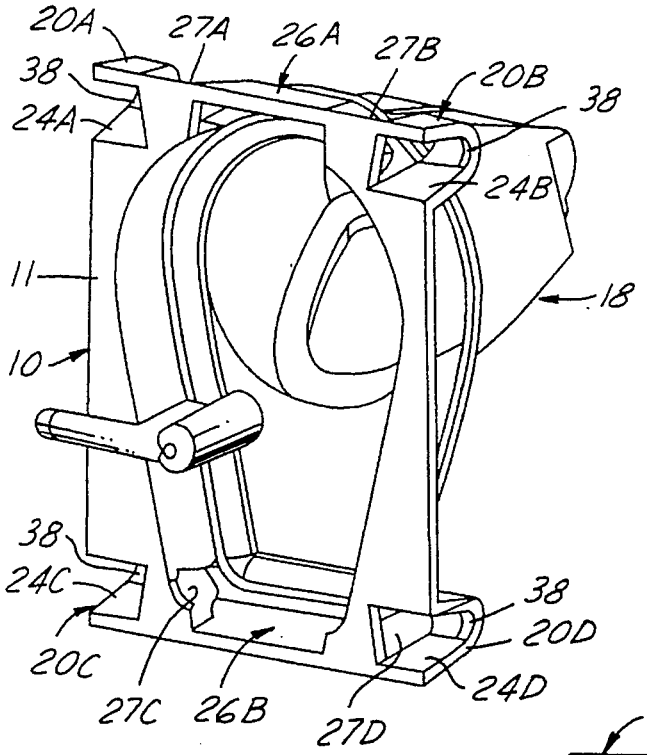
FIG. 4 is a perspective view of the cover from the side opposite that of the view of FIGS. 1 and 2.
Figure 5:
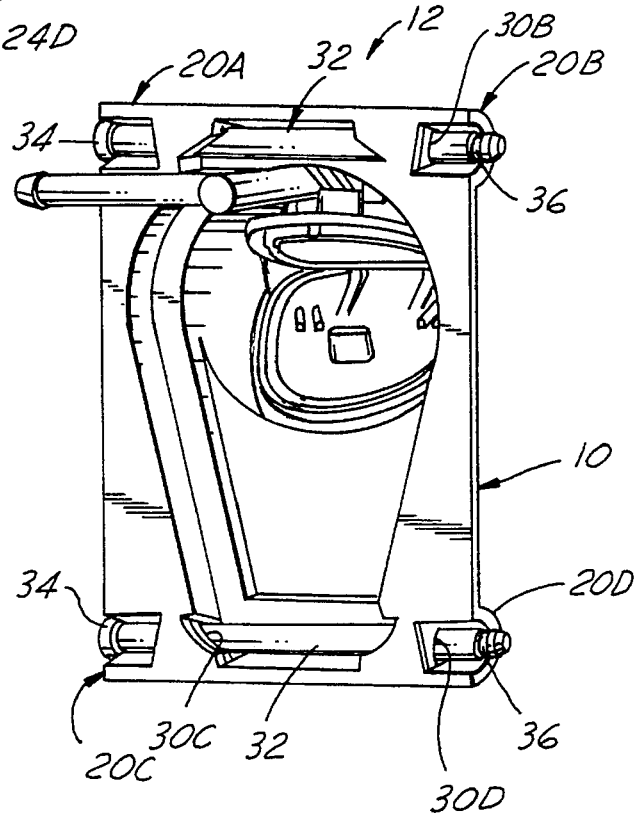
FIG. 5 is a perspective view of the assembled cover and flange from the side opposite that of the views of FIGS. 1 and 2.

The flange 12 is further formed with pairs of rounded sloping surfaces 30A, 30B and 30C, 30D which extend from the top and bottom end surfaces of the flange 12. The sloping flange surfaces 30A–D extend orthogonally to the projection recesses 24A–D and each have a rounded segment 31 (FIG. 3) located and configured so that the rounded contours are partially aligned, as best seen in FIG. 3 although axially offset along the top and bottom side.

Thus, opposing but spaced apart arcuate surfaces $S_1$, $S_2$ are formed in the flange 12 and cover 10.

A key pin 32 is inserted into each of the intervening spaces engaging the opposing surfaces $S_1$, $S_2$ to prevent separation of the cover 10 from the flange 12. The sides of the key pins 32 are each nested into the rounded end portion of the recesses 24A–D to be captured therein, with the opposing surfaces 52 engaged to positively prevent withdrawal.

Figure 6:
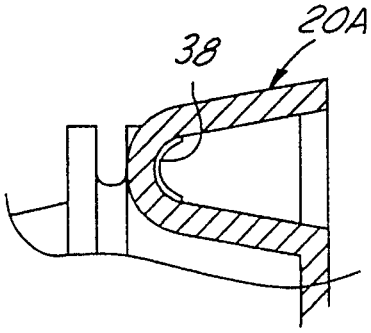
FIG. 6 is a fragmentary sectional view of one of the cover projections.

Each key pin 32 is formed with a head 34 at one end and a groove 36 at the other end. The head 34 of each pin 32 abuts against one side of the cover 10, while the grooves 36 snap over ridges 38 (FIG. 6) molded into recesses 24B, 24D when the pins 32 are fully inserted to be releasably retained.

The intake manifold 14 including the flange 12, the cover 10, and the key pins 32 are all molded from a high strength plastic composite, such as Nylon 66, which is 33% glass filled.

The flange features forming part of the connection according to the invention are designed to be molded when the manifold 14 itself is molded.

The manifold 14 is molded by upper and lower mold halves (not shown), abutting along a parting line 38. The sloping surfaces 30A, 30B thus can be formed by the top mold half, the lower sloping surfaces 30C, 30D can be formed by the lower mold half.

An end piece will form the outward facing divergent recesses 28A–28D in the flange 12.

The projections 20A–D and recesses 24A–D can also be molded by a simple mold configuration for the cover 10.

The various sloping and tapering shapes forming a part of the connection create draft angles for release from the mold cavities. Other draft angles for other surfaces will be provided in the manner well known in the art.

It is noted that the sloping surfaces 30A–D can be provided by one section of a tapered opened end recess, although to save material, the other section can be eliminated, leaving only the surfaces 30A–D, as shown.

Accordingly, a high strength releasable connection can be provided at low cost, which does not require expensive secondary operations to be performed on the intake manifold 14, or complex mold configurations and motions.

We claim:

1. A releasable connection for attaching a cover over an opening in an intake manifold, said intake manifold molded from a composite plastic material, said connection including:

a flange molded into said intake manifold defining a cover mounting surface surrounding said opening;

said cover having a main wall and a series of parallel projections extending orthogonally from said main wall;

said flange cover mounting surface having a series of first open ended recesses molded thereinto spaced and configured to receive and be fit to a respective one of said projections upon advance of said cover main wall against said flange cover mounting surface;

each of said projections having a recess extending thereinto;

a series of sloping surfaces, each surface molded into said flange and located alongside a respective one of said flange recesses, each surface extending in from a side of said mounting flange and located to extend across a respective projection recess and partially overlap a projection recess at an end portion thereof to define sets of opposing but offset surfaces on said cover and said flange respectively; and, an elongated key element inserted between and engaged by each of said aligned sets of opposing surfaces.

2. The connection according to claim 1 wherein each of said projections and recesses have tapering sides.

3. The connection according to claim 2 wherein said projection recesses and flange sloping surfaces have rounded portions partially aligned to produce arcuate opposing surfaces, and wherein said key element comprises a round pin.

4. The connection according to claim 3 wherein said cover is molded from a composite plastic material.

* * * * *